US008413649B2

(12) United States Patent
Capacci

(10) Patent No.: US 8,413,649 B2
(45) Date of Patent: Apr. 9, 2013

(54) COOKING OVEN DOOR WITH A DOOR FRAME AND A DOOR PANEL

(75) Inventor: Mirko Capacci, Meldola (IT)

(73) Assignee: Electrolux Home Products Corporation N.V., Zaventem (BE)

( * ) Notice: Subject to any disclaimer, the term of this patent is extended or adjusted under 35 U.S.C. 154(b) by 0 days.

(21) Appl. No.: 12/667,288

(22) PCT Filed: Jun. 19, 2008

(86) PCT No.: PCT/EP2008/004945

§ 371 (c)(1),
(2), (4) Date: Mar. 2, 2010

(87) PCT Pub. No.: WO2009/003592

PCT Pub. Date: Jan. 8, 2009

(65) Prior Publication Data

US 2010/0192935 A1 Aug. 5, 2010

(30) Foreign Application Priority Data

Jul. 2, 2007 (EP) ..... 07012905

(51) Int. Cl.
*F23M 7/00* (2006.01)

(52) U.S. Cl.
USPC ..... 126/190; 126/194; 126/198; 126/200; 126/273 R; 206/1.5; 206/307.1; 206/308.2; 206/387.12

(58) Field of Classification Search ..... 126/190, 126/198, 200, 194; 206/1.5, 307.1, 308.2, 206/387.11, 387.14
See application file for complete search history.

(56) References Cited

U.S. PATENT DOCUMENTS

| | | | | | |
|---|---|---|---|---|---|
| 2,536,956 | A | * | 1/1951 | Reeves | 126/200 |
| 3,828,763 | A | * | 8/1974 | Wilson | 126/200 |
| 4,542,268 | A | * | 9/1985 | Jarvis et al. | 219/685 |
| 5,368,162 | A | * | 11/1994 | Holmgren | 206/387.11 |
| 5,562,090 | A | * | 10/1996 | Katz | 126/198 |
| 5,632,062 | A | * | 5/1997 | Katz et al. | 16/412 |
| 5,819,722 | A | * | 10/1998 | Katz | 126/200 |

(Continued)

FOREIGN PATENT DOCUMENTS

| | | | |
|---|---|---|---|
| DE | 19734959 | C1 | 11/1998 |
| DE | 19748196 | A1 | 5/1999 |

(Continued)

OTHER PUBLICATIONS

International Search Report for PCT/EP2008/004945 dated Jan. 26, 2009.

*Primary Examiner* — Kenneth Rinehart
*Assistant Examiner* — Jorge Pereiro
(74) *Attorney, Agent, or Firm* — Workman Nydegger

(57) ABSTRACT

The present invention relates to a cooking oven door including at least one door frame and at least one door panel. The door frame includes a U-shaped part with a center portion and two legs. The U-shaped part is formed as a one-piece plastic part. The door panel is inserted within the U-shaped part. The U-shaped part encloses three circumferential sides of the door panel. The U-shaped part comprises support elements on its inner side in order to hold the door panel in a predetermined position. At least one fixing element is attached or attachable on at least one free end portion of the leg in order to secure the door panel within the U-shaped part.

21 Claims, 4 Drawing Sheets

U.S. PATENT DOCUMENTS

| | | | | |
|---|---|---|---|---|
| 5,882,052 | A * | 3/1999 | Whitehead | 292/80 |
| 5,981,927 | A * | 11/1999 | Osepchuk et al. | 219/740 |
| 6,814,225 | B2 * | 11/2004 | Belden et al. | 206/1.5 |
| 7,022,957 | B2 * | 4/2006 | Bakanowski et al. | 219/741 |
| 2003/0024925 | A1 * | 2/2003 | Graves et al. | 219/681 |
| 2007/0187387 | A1 * | 8/2007 | Kim et al. | 219/391 |

FOREIGN PATENT DOCUMENTS

| | | | |
|---|---|---|---|
| DE | 29912626 | U1 | 9/1999 |
| DE | 10336138 | B3 | 10/2004 |
| DE | 102004002469 | A1 | 8/2005 |
| DE | 102005004944 | A1 | 8/2006 |
| EP | 121893 | A2 * | 10/1984 |
| WO | WO 9924759 | A2 * | 5/1999 |

* cited by examiner

COOKING OVEN DOOR WITH A DOOR FRAME AND A DOOR PANEL

BACKGROUND OF THE INVENTION

1. Field of the Invention

The present invention relates to a cooking oven door according to claim 1. Further, the present invention relates to a fixing element for securing at least one door panel in a door frame according to claim 18. Additionally, the present invention relates to a U-shaped part for inserting a door panel according to claim 19.

2. Background and Relevant Art

A cooking oven requires a window in the oven door, so that the user is able to look inside the oven chamber without opening the cooking oven door. The cooking oven door should be made of temperature-resistant materials. Further, the cooking oven door should provide a sufficient thermal insulation.

Known cooking oven doors consist usually of several parts. For example, a door frame includes a profile part for each side. A typical cooking oven door comprises one or more transparent door panels, which are made of glass or transparent plastics. The door panel is usually integrated in a door frame. Additionally, a further door panel may be arranged on the inner side and/or outer side of the frame.

Typically the door frame consists of several frame parts and each frame part is provided for one circumferential side of the door panel. The production of such an oven door is very complex and generates high costs. The frame parts have to be put together to the door frame. This requires several working steps.

Additionally, the door panel must be inserted into the door frame before or after putting together the door frame.

US 2005/0076900 A1 discloses an oven door with a U-shaped door frame including several profile parts and fixing elements. The profile parts are plugged together in order to obtain said U-shaped frame. Several door panels are inserted within the U-shaped frame. At the free end portions of the two legs of the U-shaped frame a lever mechanism is attached. The assembling of that oven door requires a lot of working steps.

DE 197 34 959 C2 discloses an oven door with a U-shaped door frame. The U-shaped door frame is a one-piece part. One door panel is inserted within said U-shaped door frame, so that three sides enclose the door panel. A further part for the fourth side of the door frame is required in order to secure the door panel within the door frame. Additionally, fixing elements are required to connect said further part to the U-shaped door frame.

BRIEF SUMMARY OF THE INVENTION

It is an object of the present invention to provide a cooking oven door, which is simply and cheaply producible.

This object is achieved by the oven door according to claim 1.

According to the present invention the cooking oven door includes at least one door frame and at least one door panel, wherein

- the door frame includes a U-shaped part with a centre portion and two legs,
- the U-shaped part is formed as a one-piece plastic part,
- the door panel is inserted within the U-shaped part,
- the U-shaped part encloses three circumferential sides of the door panel,

- the U-shaped part comprises support elements on its inner side in order to hold the door panel in a predetermined position, and
- at least one fixing element is attached or attachable on at least one free end portion of the leg in order to secure the door panel within the U-shaped part.

According to the present invention an U-shaped part is provided with the at least one inserted door panel, wherein the door panel is secured by the at least one fixing element at the free end portion of the leg of the U-shaped part. The assembly of the inventive cooking oven door requires only a few steps. At first the door panel or the door panels have to be inserted within the U-shaped door frame. Then the at least one fixing element is attached to the free end of one leg of the U-shaped frame. For example, the U-shaped part may be made as a one-piece injection molded part.

In a preferred embodiment of the present invention the fixing element is formed as a one-piece plastic part. This simplifies the production process of the fixing element as well as of the whole cooking oven door.

Further, the fixing element may be detachably arranged on the free end portion of the leg. This allows a disassembling of the cooking oven door and an exchanging of single parts of said cooking oven door.

In addition, the fixing element may be directly attached or attachable at the free end portion of the leg. No further means are necessary in order to connect the fixing element to the U-shaped frame.

Preferably, at least one pin element is arranged on the free end portion of the leg and the fixing element is attached or attachable on said pin element. Further, the fixing element is attached or attachable on the pin element.

In the preferred embodiment of the present invention the fixing element comprises a blind hole. Further, the blind hole and the pin element may form a rotary union between the fixing element and the free end portion of the leg. This is a simple and cheap way to form a rotary union. Additionally, the fixing element comprises a handle bar. The handle bar allows that the fixing element is manual pivoting with said handle bar.

Further, the fixing element may comprise a lock element. This allows a stable state of the fixing element at the U-shaped part.

Preferably, the lock element and the pin element form a snap-on connection between the fixing element and the free end portion of the leg. This is an easy and cheap construction, which allows that the fixing element is detach-able from the U-shaped part.

The fixing element may further comprise at least one gripping element. The door panel may be gripped between the U-shaped part and the gripping element.

In a usual embodiment of the present invention the door panel is formed as a substantially rectangular sheet.

Additionally, a further door panel may be arranged on at least one large-area side of the U-shaped part. Normally, the cooking oven door requires several door panels. A few door panels may be inserted within the U-shaped part. One or two door panels may be attached at the large-area sides of the U-shaped part.

In order to guarantee a high stability of the door frame, the fixing element may be attached or attachable on each of the both legs of the U-shaped part.

For example, the door panel is made of glass. Alternatively, the door panel is made of transparent plastics.

Further, the U-shaped part is made of a polymer material, preferably of one single polymer material.

Also the fixing element may be made of a polymer material, preferably of one single polymer material.

In the preferred embodiment of the present invention the U-shaped part comprises at its inner side support elements and/or spacing elements provided for holding the door panel. The spacing elements may be provided for keeping a predetermined distance between at least two neighboring door panels. The support elements and/or the spacing elements are formed as inward-looking appendices. The U-shaped part with the support elements and/or the spacing elements may be made as a one-piece injection molded part.

In a special embodiment of the present invention at least one door panel may comprise at least one shied grid in order to screen electromagnetic waves. In this case the oven door may be provided for a microwave oven.

Additionally, the inventive cooking oven door is provided for a cooking oven for domestic use.

The object of the invention is further achieved by a fixing element for securing a door panel within a U-shaped part of a door frame, wherein the fixing element is provided for a cooking oven door as described above.

The object of the invention is further achieved by a U-shaped part for inserting a door panel, wherein the U-shaped part is provided for a cooking oven door as described above.

The novel and inventive features believed to be the characteristic of the present invention are set forth in the appended claims.

BRIEF DESCRIPTION OF THE DRAWINGS

The invention will be described in further detail with reference to the drawing, in which.

DETAILED DESCRIPTION OF THE PREFERRED EMBODIMENTS

Figure 1:
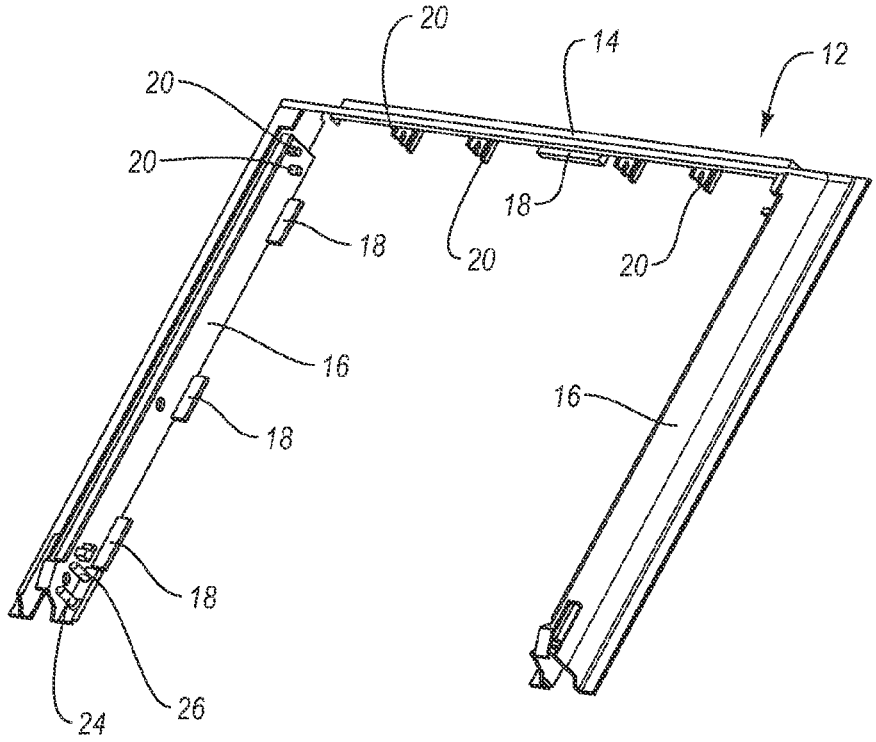
FIG. 1 illustrates a perspective view of a U-shaped part of a door frame for a cooking oven door according to a preferred embodiment of the present invention.

FIG. 1 illustrates a perspective view of a U-shaped part 12 of a door frame for a cooking oven door according to a preferred embodiment of the present invention. The U-shaped part 12 comprises a centre portion 14 and two legs 16. The legs 16 are ordered perpendicular to the centre portion 14. The centre portion 14 and the two legs 16 are further arranged within the same plane.

On the inside of the U-shaped part 12 are support elements 18 and spacing elements 20. The support elements 18 are provided to hold a door panel 10. The spacing elements 20 are also provided to hold the door panel 10 on the one hand. On the other hand the spacing elements 20 are provided to keep a distance between two neighboring door panels 10, if the cooking oven door comprises two or more door panels 10 with the U-shaped part 12.

In this example three door panels 10 may be inserted into the U-shaped part 12. A further door panel may be fixed on an outer side of the U-shaped part 12 by gluing. The area of said further door panel is marginally bigger than that area, which is spanned by the U-shaped part 12 in FIG. 1.

In the free end portion of the leg 16 there are a first pin element 24 and a second pin element 26. The first pin element 24 and the second pin element 26 are arranged parallel to the inner side of the U-shaped part 12. Further, the first pin element 24 and the second pin element 26 are substantially cylindrical. The first pin element 24 and the second pin element 26 are provided for mounting a fixing element 22. The fixing element 22 holds the door panels within the U-shaped part 12. The fixing element 22 is provided for the free end portion of each leg 16.

Figure 2:
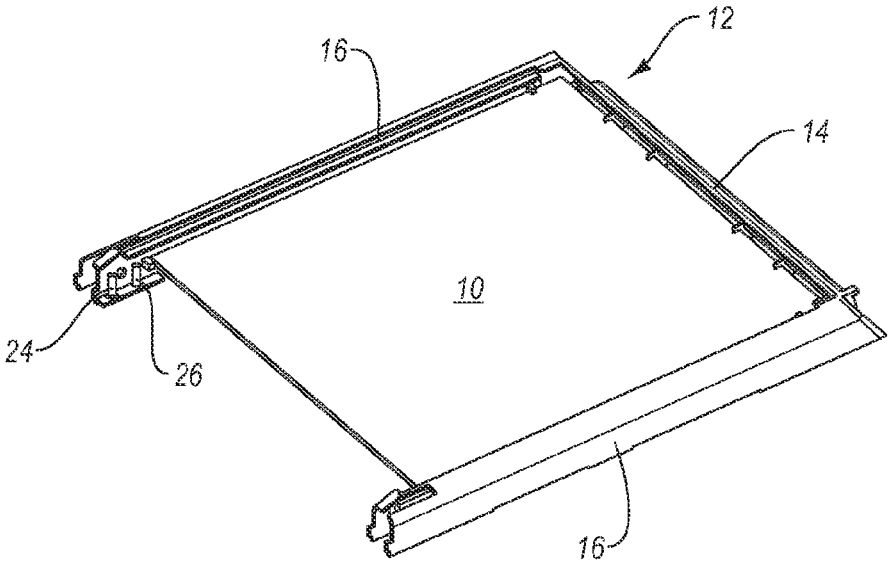
FIG. 2 illustrates a perspective view of the U-shaped part of the door frame with an integrated door panel according to the preferred embodiment of the present invention.

FIG. 2 illustrates a perspective view of the U-shaped part 12 of the door frame with an integrated door panel 10 according to the preferred embodiment of the present invention. The door panel 10 has a rectangular design. The inner dimensions of the U-shaped part 12 are marginally bigger than the outer dimension of the door panel 10. Three circumferential sides of the door panel 10 are enclosed by the inner sides of the U-shaped part 12. Some outer portions of the large area side of the door panel 10 rest upon the support elements 18 and upon those space elements 20 neighboring to said support elements 18.

The form of the U-shaped part 12 allows that the door panel 10 may be inserted into the U-shaped part 12 by only one single step. A further step is required in order to mount the fixing elements 22 onto the free end portion of the leg 16.

Figure 3:
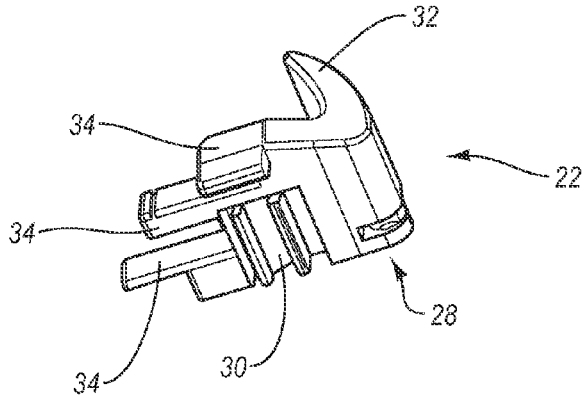
FIG. 3 illustrates a perspective view of a fixing element for the door frame according to the preferred embodiment of the present invention.

FIG. 3 illustrates a perspective view of a fixing element 22 for the door frame according to the preferred embodiment of the present invention. The fixing element 22 is substantially L-shaped. The fixing element 22 comprises a blind hole 28. The blind hole 28 is provided for receipt the first pin element 24, so that the fixing element 22 is pivoting at the leg 16. The fixing element 22 comprises a lock element 30. The lock element 30 is provided to snap in onto the second pin element 26, so that the fixing element 22 is fastened on the free end portion of the leg 16.

Further, the fixing element 22 comprises a handle bar 32 for a manual pivoting of said fixing element 22. The handle bar 32 forms the first leg of the L-shaped fixing element 22. Additionally, the fixing element 22 comprises gripping elements 34. The gripping elements 34 are arranged at the second leg of the L-shaped fixing element 22. In this example the gripping elements 34 are provided to grip one or up to three door panels 10.

If the fixing element 22 is in the fastened position the door panel 10 is clamped between the U-shaped part 12 and said fixing element 22. Thus the door panel 10 can be secured in an easy way by plugging on and pivoting the fixing element 22. The fixing element 22 is provided for the free end portion of the leg 16 on the left hand side in FIG. 1.

Figure 4:
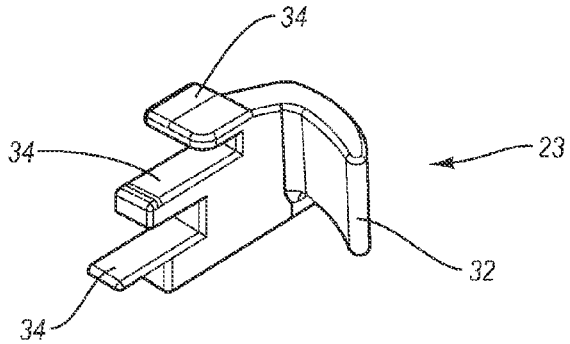
FIG. 4 illustrates a perspective view of a further fixing element for the door frame according to the preferred embodiment of the pre-sent invention.

FIG. 4 illustrates a perspective view of a further fixing element 23 for the door frame according to the preferred embodiment of the present invention. The further fixing element 23 is symmetrical to the fixing element 22. In other aspects the further fixing element 23 has the same properties as the fixing element 22. The further fixing element 23 is provided for the free end portion of the leg 16 on the right hand side in FIG. 1.

Figure 5:
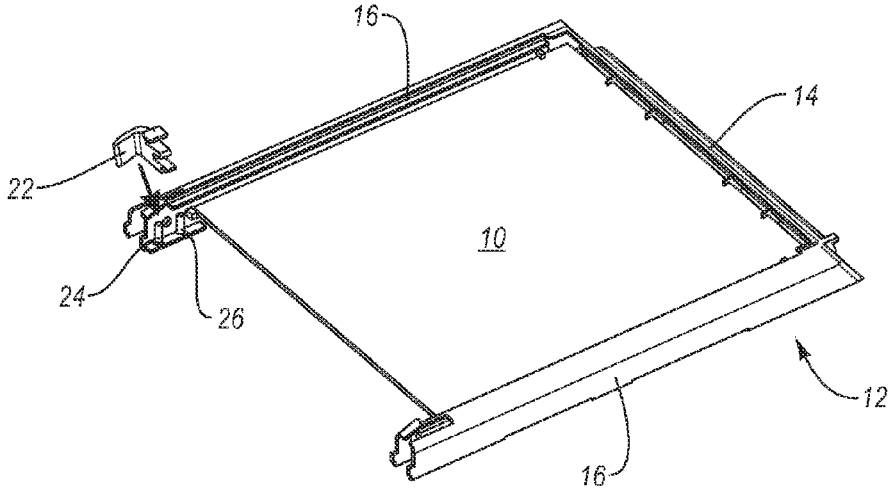
FIG. 5 illustrates a perspective view of the U-shaped part with the integrated door panel and two fixing elements in an un-mounted state according to the preferred embodiment of the present invention.

FIG. 5 illustrates a perspective view of the U-shaped part 12 with the integrated door panel 10 and one fixing elements 22 in an un-mounted state according to the preferred embodiment of the present invention. FIG. 5 shows how the fixing element 22 has to be plugged onto the first pin element 24. The blind hole 28 of the fixing element 22 receipts the first pin element 24.

Figure 6:
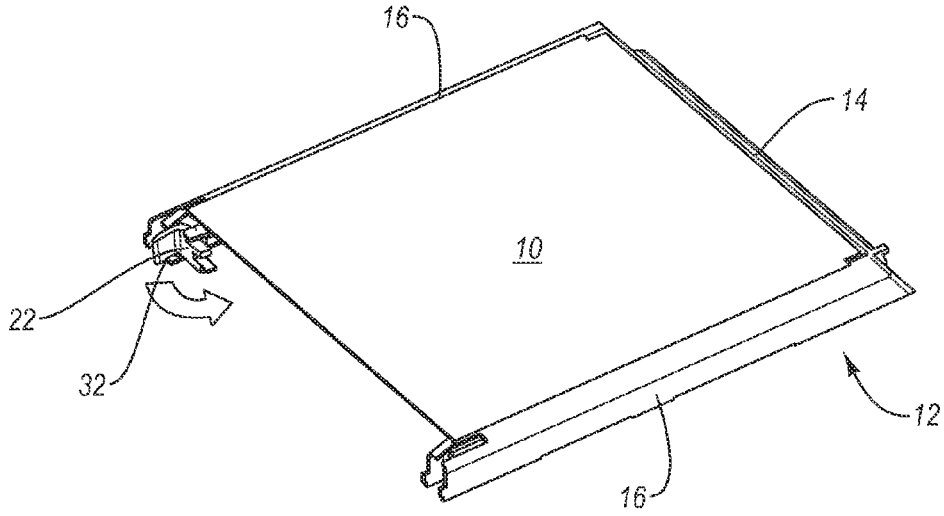
FIG. 6 illustrates a perspective view of the U-shaped part with the integrated door panel and two fixing elements in a plugged state according to the preferred embodiment of the present invention.

FIG. 6 illustrates a perspective view of the U-shaped part 12 with the integrated door panel 10 and two fixing elements 22 in a plugged state according to the preferred embodiment of the present invention. In this state the fixing element 22 is pivoting on the U-shaped part 12 within a range of about 90°. With the handle bar 32 the fixing element 22 is pivoting, so that the second pin element 26 snaps into the lock element 30.

Figure 7:
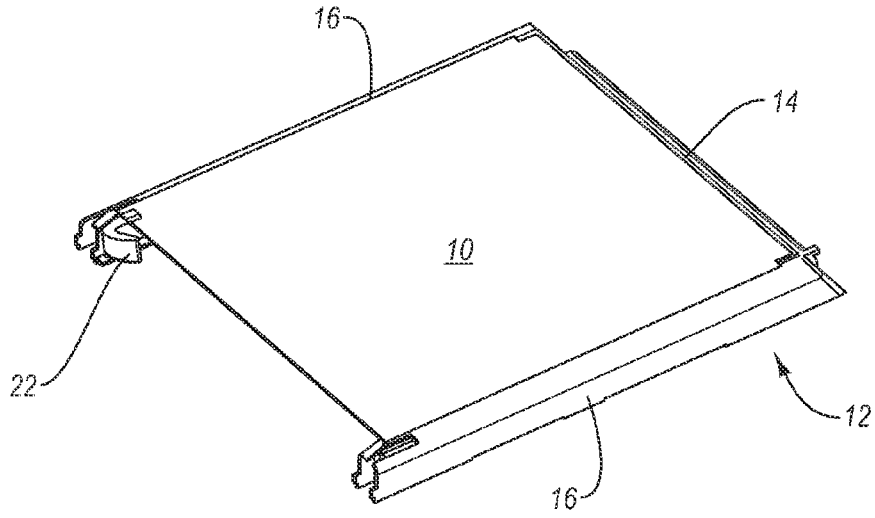
FIG. 7 illustrates a perspective view of the U-shaped part with the integrated door panel and two fixing elements in a mounted state according to the preferred embodiment of the present invention.

FIG. 7 illustrates a perspective view of the U-shaped part with the integrated door panel 10 and the fixing element 22 in a mounted state according to the preferred embodiment of the present invention. In this position the gripping elements 34 of the fixing element 22 grips the door panel 10, so that the door panel 10 is clamped between the U-shaped part 12 and said fixing element 22.

Only three steps are necessary in order to mount the door panel 10 into the U-shaped frame 12. At first the door panel 10 has to be inserted into the U-shaped frame 12. Then the fixing element 22 and the further fixing element 23 have to be fastened the free end portions of the legs 16 on the left hand side and right hand side, respectively.

Figure 8:
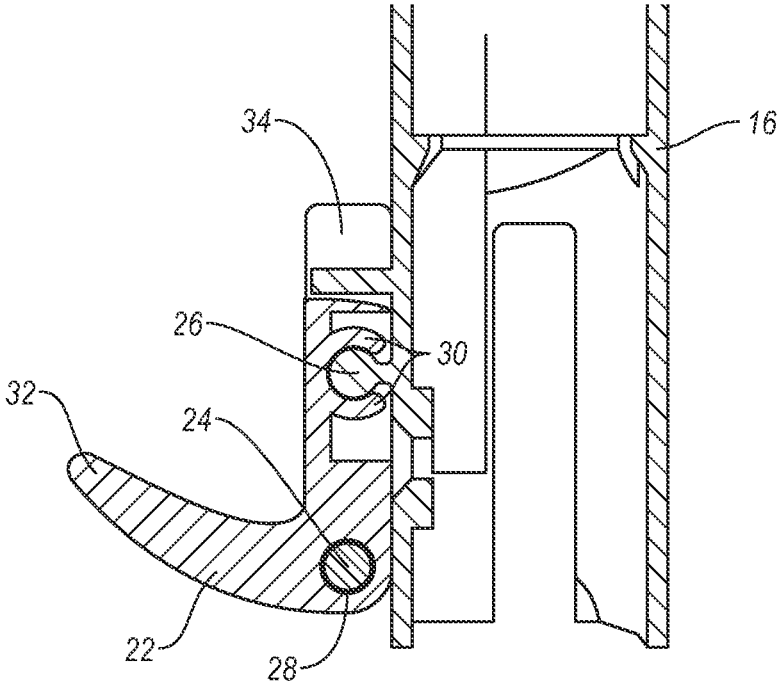
FIG. 8 illustrates a sectional view of the fixing element in the mounted state and the free end portion of the U-shaped part according to the preferred embodiment of the present invention.

FIG. 8 illustrates a sectional view of the fixing element 22 in the mounted state and the free end portion of the U-shaped part 12 according to the preferred embodiment of the present invention. FIG. 8 shows that the fixing element 22 is fastened at the first pin element 24 and second pin element 26 of the free end portion of the U-shaped part 12. The first pin element 24 is receipt by the blind hole 28 of the fixing element 22. The second pin element 26 is receipt by the lock element 30 of the fixing element 22. The lock element 30 includes two springy blades. In the mounted state the second pin element 26 is between said two springy blades.

The oven door according to the present invention may include one or more door panels 10 within the U-shaped part 12. On both large-area sides of the U-shaped part 12 an additional door panel may be fixed. The additional door panel may be fixed by gluing, for example. The area of said additional door panel is marginally bigger than that area, which is spanned by the U-shaped part 12. The door panel is made of glass or transparent plastics.

Although illustrative embodiments of the present invention have been described herein with reference to the accompanying drawing, it is to be understood that the present invention is not limited to those precise embodiments, and that various other changes and modifications may be affected therein by one skilled in the art without departing from the scope or spirit of the invention. All such changes and modifications are intended to be included within the scope of the invention as defined by the appended claims.

LIST OF REFERENCE NUMERALS

10 door panel
12 U-shaped frame
14 centre portion
16 legs
18 support elements
20 spacing elements
22 fixing element
24 first pin element
26 second pin element
28 blind hole
30 lock element
32 handle bar
34 gripping elements

We claim:

1. A cooking oven door comprising at least one door frame and at least one door panel, wherein:
the door frame includes a U-shaped part with a center portion and two legs;
the U-shaped part is formed as a one-piece plastic part;
the door panel is inserted within the U-shaped part;
the U-shaped part encloses three circumferential sides of the door panel;
the U-shaped part comprises support elements on its inner side in order to hold the door panel in a predetermined position; and
at least one fixing element is attached or attachable on at least one free end portion of the leg in order to secure the door panel within the U-shaped part;
wherein:
the fixing element is detachably arranged at the free end portion of the leg;
at least one pin element is arranged on the free end portion of the leg;
the fixing element is attached or attachable on the pin element;
the fixing element comprises a blind hole; and
the blind hole and the pin element form a rotary union between the fixing element and the free end portion of the leg.

2. The cooking oven door according to claim 1, wherein the fixing element is formed as a one-piece plastic part.

3. The cooking oven door according to claim 1, wherein the fixing element comprises a handle bar.

4. The cooking oven door according to claim 3, wherein the fixing element is manually pivoting or pivotable with the handle bar.

5. The cooking oven door according to claim 4, wherein:
the fixing element comprises a lock element; and
the lock element and the pin element form a snap-on connection between the fixing element and the free end portion of the leg.

6. The cooking oven door according to claim 4, wherein:
the fixing element comprises at least one gripping element; and
the door panel is gripped between the U-shaped part and the gripping element.

7. The cooking oven door according to claim 1, wherein the door panel is formed as a substantially rectangular sheet.

8. The cooking oven door according to claim 1, wherein a further door panel is arranged on at least one large-area side of the U-shaped part.

9. The cooking oven door according to claim 1, wherein the fixing element is attached or attachable on each of the both legs of the U-shaped part.

10. The cooking oven door according to claim 1, wherein the door panel is made of glass or of transparent plastics.

11. The cooking oven door according to claim 1, wherein:

the U-shaped part comprises at its inner side support elements spacing elements provided for holding the door panel; and the spacing elements are provided for keeping a predetermined distance between at least two neighboring door panels.

12. The cooking oven door according to claim 11, wherein the support elements and/or the spacing elements are formed as inward-looking appendices.

13. The cooking oven door according to claim 1, wherein at least one door panel comprises at least one shield grid in order to screen or protect from electromagnetic waves, and the oven door is provided for a microwave oven.

14. The cooking oven door according to claim 1, wherein the oven door is provided for a cooking oven for domestic use.

15. A fixing element for securing a door panel within a U-shaped part of a door frame, wherein the fixing element is provided for a cooking oven door according to claim 1.

16. A U-shaped part for inserting a door panel of a cooking oven door, wherein the U-shaped part is provided for a cooking oven door according to claim 1.

17. The cooking oven door according to claim 1, wherein the fixing element is directly attached at the free end portion of the leg.

18. The cooking oven door according to claim 1, wherein the U-shaped part is made of a polymer material.

19. The cooking oven door according to claim 1, wherein the fixing element is made of a polymer material.

20. The cooking oven door according to claim 1, wherein the U-shaped part and the fixing element are made of a single polymer material.

21. The cooking oven door according to claim 1, wherein the U-shaped part and the fixing element are made of a thermoplastic material.

* * * * *